US007015409B2

(12) United States Patent
Duffek et al.

(10) Patent No.: US 7,015,409 B2
(45) Date of Patent: Mar. 21, 2006

(54) POWER TOOL TRIGGER

(75) Inventors: Donald John Duffek, Hartford, WI (US); Scott Robert Fischer, Menomonee Falls, WI (US); David Brian Griep, Rubicon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 37 days.

(21) Appl. No.: 10/743,559

(22) Filed: Dec. 22, 2003

(65) Prior Publication Data

US 2004/0149553 A1 Aug. 5, 2004

Related U.S. Application Data

(60) Provisional application No. 60/472,839, filed on May 23, 2003, provisional application No. 60/436,427, filed on Dec. 23, 2002.

(51) Int. Cl.
*H01H 9/06* (2006.01)

(52) U.S. Cl. ..... 200/332.2; 200/522

(58) Field of Classification Search ..... 200/43.17, 200/61.85, 522, 332.2
See application file for complete search history.

(56) References Cited

U.S. PATENT DOCUMENTS

| | | | | |
|---|---|---|---|---|
| 3,646,298 | A * | 2/1972 | Weber et al. | 200/332.2 |
| 4,296,290 | A * | 10/1981 | Peot | 200/325 |
| 4,991,472 | A | 2/1991 | Hollingsworth | |
| 5,054,563 | A | 10/1991 | Zapf | |
| 5,205,540 | A * | 4/1993 | Clapp | 251/339 |
| 5,401,928 | A | 3/1995 | Kelley | |
| 6,111,515 | A | 8/2000 | Schaer et al. | |
| 6,213,372 | B1 | 4/2001 | Chen | |
| 6,555,773 | B1 * | 4/2003 | Broghammer et al. | 200/61.85 |
| 6,610,946 | B1 * | 8/2003 | Covell et al. | 200/321 |

FOREIGN PATENT DOCUMENTS

| | | |
|---|---|---|
| EP | 0 164 307 | 4/1985 |
| EP | 0 527 550 | 2/1993 |
| EP | 1 240 982 | 9/2002 |
| EP | 1 321 246 | 6/2003 |

* cited by examiner

*Primary Examiner*—Michael A. Friedhofer
(74) *Attorney, Agent, or Firm*—Michael Best & Friedrich LLP

(57) ABSTRACT

A trigger assembly and a power tool. The trigger assembly includes a housing and a trigger. The trigger is movably supported by the housing and includes a support portion and a contact portion. The housing includes an opening, and the support portion at least partially extends into the opening. In some aspects and in some constructions, the support portion has a first width, and the contact portion has a second width, the second width of the contact portion being greater than the first width of the support portion. The trigger includes an upper protrusion that may prevent the operator's finger from being pinched between the trigger and the housing. The trigger may include an angled portion extending between the support portion and the contact portion on opposite sides of the trigger. The angled portion may include multiple ribs defining grooves between the ribs.

45 Claims, 11 Drawing Sheets

POWER TOOL TRIGGER

RELATED APPLICATIONS

The present application claims the benefit of prior-filed, provisional patent application Ser. No. 60/436,427, filed Dec. 23, 2002 and prior-filed, provisional patent application Ser. No. 60/472,839, filed May 23, 2003, the disclosures of which are hereby incorporated by reference.

FIELD OF THE INVENTION

This invention relates to power tools and, more particularly, to triggers for power tools.

BACKGROUND OF THE INVENTION

Power tools are used to perform operations, such as sawing or drilling. A trigger is typically operated to control the power tool. The trigger may be pivotally supported on a handle of the power tool. The trigger may be interconnected with an ON/OFF switch for controlling the motor. The trigger is moved between a rest position, in which the switch is OFF, and a depressed or operating position, in which the switch is ON and the power tool is operated. The trigger is generally biased toward the rest position, by a spring. The operator overcomes the biasing force to move the trigger from the rest position to the depressed position.

SUMMARY OF THE INVENTION

Generally, an operator grips the handle of a power tool such that one or more of the operator's fingers (i.e., the operator's index finger) contacts the trigger. The operator then applies an operating force with the index finger to actuate the trigger and overcome the biasing force on the trigger to operate the power tool.

FIG. 8 illustrates a cross-sectional view of a prior art trigger device 110 including a trigger 114 interconnected to a housing 118 and a handle 122. The trigger 114 extends through an opening 126 in the handle 118 to operate an ON/OFF switch (not shown). The trigger 114 has a width dimension WO that remains substantially the same along the entire depth D (in FIG. 8) and length L (in FIG. 9) of the trigger 114. As shown in FIG. 8, the trigger 114 may be relatively narrow, and the biasing force on the trigger 114 may apply a relatively large amount of pressure on the operator's finger. This pressure may cause discomfort and make it difficult for the operator to operate the power tool for an extended period of time.

In some prior art trigger devices, the biasing return force on the trigger has been reduced to help reduce the pressure on the operator's finger. However, a certain amount of force is required to maintain proper operation throughout the life of the trigger device. A spring having a weaker biasing force may wear out sooner. Also, a spring having a weaker biasing force will provide less resistance and will have a "softer" feel for the operator. This "softer" feel may reduce the operator's control over the speed of the power tool.

Also, in some prior art trigger devices, the width of the entire trigger is increased. However, to accommodate the wider trigger in the handle, the opening in the housing must be at least as wide as the trigger, and is wider than the opening for narrower standard trigger. The wider opening for the widened trigger may allow debris and other contamination to enter the handle. The switch is usually disposed within the handle near the trigger, and such contamination can impede the operation of and reduce the life of the switch.

In addition, in some prior art trigger devices, the length of the trigger is increased to permit the operator to place more than one finger on the trigger (i.e., a paddle switch). Generally, in such devices, the operator actuates the trigger with the index finger and grips the handle with the remaining fingers. Transferring an additional finger from the grip of the handle to the actuation of the trigger may reduce the control the operator has over the power tool. Also, the length of the opening in the handle must be increased to accommodate the increased the length of the trigger. As mentioned above, the increased size of the opening increases the risk of debris and contamination entering the handle.

Further, with some prior art trigger devices, the operator's finger may be pinched between the trigger and the housing. FIG. 9 illustrates a prior art trigger device 110 having a gap 130 between the prior art trigger 114 and the housing 118. As the prior art trigger 114 pivots relative to the housing 118, the gap 130 is exposed between the prior art trigger 114 and the housing 118 (i.e., when the trigger 114 is in the depressed position, as shown in FIG. 9). The operator's finger F (illustrated by the broken lines) may move into the gap 130 and be pinched between the prior art trigger 114 and the housing 118 as the trigger 114 returns to the rest position. A pinched finger F is uncomfortable for the operator and may prevent the trigger 114 from returning to the rest position corresponding to the OFF position of the switch.

The present invention provides a trigger assembly and power tool which alleviates one or more independent problems with existing trigger devices and power tools. In some aspects and in some constructions, the trigger includes a relatively larger surface area that contacts the operator's finger. The relatively larger surface area decreases the pressure exerted on the operator's finger. In some constructions and in some aspects, the trigger includes an anti-pinch portion that fills and/or covers the gap between the trigger and the housing to prevent the operator's finger from being pinched between the trigger and the housing.

In some aspects, the present invention provides a trigger assembly including a housing and a trigger. The trigger is movably supported by the housing and includes the support portion and a contact portion. The housing includes an opening, and the support portion at least partially extends through the opening into the housing. The support portion has a first width dimension, and the contact portion has a second width dimension. The second width dimension of the contact portion is greater than the first width dimension of the support portion. The housing may include a handle, and the trigger may be supported on the handle.

The operator's hand grips the handle, and the operator's finger generally contacts the contact portion of the trigger. In some aspects and in some constructions, the width of support portion is similar to the standard width of some prior art triggers, and the width of the contact portion is greater than the standard width of some prior art triggers. The increased width of the contact portion increases the surface area of the contact portion and may reduce the pressure on the operator's finger by distributing the force over a greater surface area.

In some aspects and in some constructions, the trigger assembly may reduce pressure on the operator's finger. Because the support portion has a width that is the same as the standard width of some prior art triggers, the size of the opening is not increased, and the risk of contamination through the opening is not increased. Additionally, the trigger may be retro-fittable onto existing power tools because the support portion fits through the standard width opening of some prior art handles and trigger devices. The size of the required opening is not changed so that the design and manufacturing process of the housing and handle does not have to change. The biasing force on the trigger may remain the same so that there is no significant difference in control of speed or in the expected life of the trigger assembly. Also, only one finger is needed to actuate the trigger so that the remaining fingers may grip the handle to control the power tool.

In some aspects, the present invention provides a trigger device including a trigger assembly including a housing and a trigger. The trigger is movably supported by the housing and includes the support portion and a contact portion. The housing includes an opening, and the support portion at least partially extends through the opening into the housing. The trigger also includes an upper protrusion projecting outwardly from the contact portion. A space is defined between the trigger and the portion of the housing surrounding the opening, and the upper protrusion projects into the space between the trigger and the housing.

In some aspects and in some constructions, the upper protrusion of the trigger may prevent the operator's finger from being pinched between the trigger and the housing and causing discomfort for the operator. Because the trigger does not pinch the operator's finger, the upper protrusion may also permit the trigger to freely return to a rest position.

Independent features and independent advantages of the present invention will become apparent to those skilled in the art upon review of the following detailed description, claims and drawings.

Figure 1:
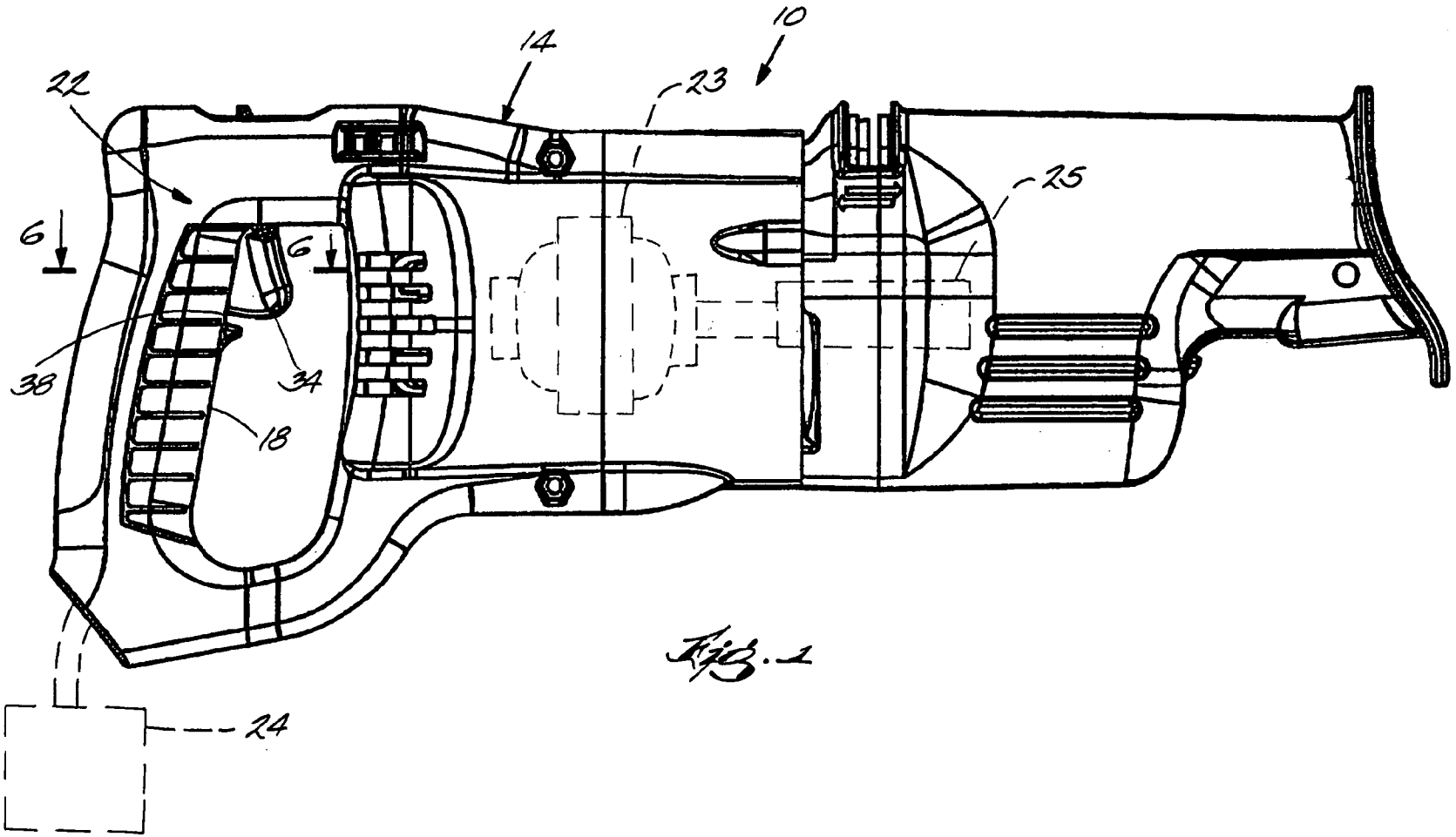
FIG. 1 is a side view of a power tool and a trigger assembly embodying aspects of the invention.

Before any embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

FIG. 1 illustrates a power tool 10 and a trigger assembly 22 embodying aspects of the invention. The power tool 10 includes a housing 14 providing a handle 18, and the trigger assembly 22 is supported on the handle 18. In the illustrated construction, the power tool 10 includes a motor 23 disposed within the housing 14. The motor 23 is selectively connectable to a power source 24 such as, for example, an AC electrical power source (i.e., line power through a cord), a DC electrical power source (i.e., a battery), or a pneumatic source, etc. The motor 23 cooperates with a drive mechanism 25 to drive a tool element (not shown) to perform the function of the power tool 10.

In the illustrated construction, the power tool 10 is a reciprocating saw including a reciprocating drive mechanism 25 that reciprocates a saw blade (not shown). The drive mechanism 25 may be an eccentric drive (not shown), such as that shown in U.S. Pat. No. 5,079,844, a wobble plate drive (not shown), such as that shown in U.S. Pat. Nos. 5,025,562 and 5,050,307, or a gear and eccentric drive arm assembly, such as that shown in U.S. patent application Ser. No. 09/704,914, filed Nov. 2, 2000, the contents of which are incorporated herein by reference. It should be understood that, in other constructions (not shown), the drive mechanism may be another type of reciprocating drive mechanism.

It should also be understood that, in other constructions (not shown), the power tool 10 may be another type of power tool having another type of drive mechanism, such as, for example, a circular saw, drill, hammer drill, sander, router, impact wrench, or other power tool or equipment. In addition, it should be understood that, in such other constructions (not shown), the tool element may be a drill bit, a rotary saw blade, an abrasive element, a socket, or other tool element.

Further, it should be understood that the power tool 10 may be an electrical power tool which is corded (as shown in the illustrated construction) or cordless. It should also be understood that, in other constructions (not shown), the power tool 10 may include another type of motor such as an internal combustion engine, and the power tool 10 may also be a trimmer, blower, chain saw, or other power tool or equipment.

Figure 2:
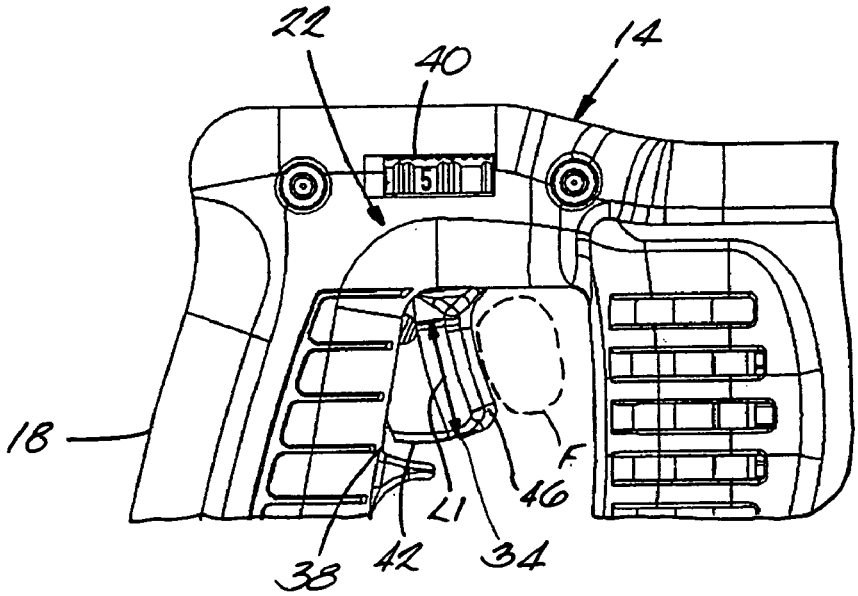
FIG. 2 is an enlarged side view of a portion of the power tool and the trigger assembly shown in FIG. 1 with the trigger in the rest position.

The trigger assembly 22 includes a trigger 34 movably supported by the handle 18. The handle 18 defines an opening 38, and at least a portion of the trigger 34 extends through the opening 38 and into the handle 18. In the illustrated construction, the trigger 34 is pivotally supported by the handle 18, and the trigger 34 is movable between a rest position (shown in FIGS. 2 and 3) and a depressed position (shown in FIGS. 4 and 5). The trigger 34 pivots with respect to the handle 18. The trigger 34 generally moves toward the handle 18 while moving from the rest position (FIG. 2) to the depressed position (FIG. 4) and away from the handle 18 while moving from the depressed position (FIG. 4) to the rest position (FIG. 2). In other constructions (not shown), the trigger 34 may move in a different manner such as, for example, sliding, linear movement, relative to the handle 18.

As shown in FIGS. 2–5, the trigger 34 is operable to control a switch 39 which selectively connects the power source to the motor to drive the tool element. When the trigger 34 is in the rest position (FIG. 2), the switch 39 is in the OFF position, and the motor is not operated to drive the tool element. As the trigger 34 is depressed (moved to the position shown in FIG. 4), the switch 39 is moved to the ON position in which the power source may be electrically connected to the motor 23 to drive the tool element. The trigger 34 and switch 39 may provide speed control such that an increase in movement of the trigger 34 toward the depressed position results in a corresponding increase in speed of the motor 23. In the illustrated construction, the power tool 10 includes a speed control assembly 40 including a dial switch.

Figure 6:
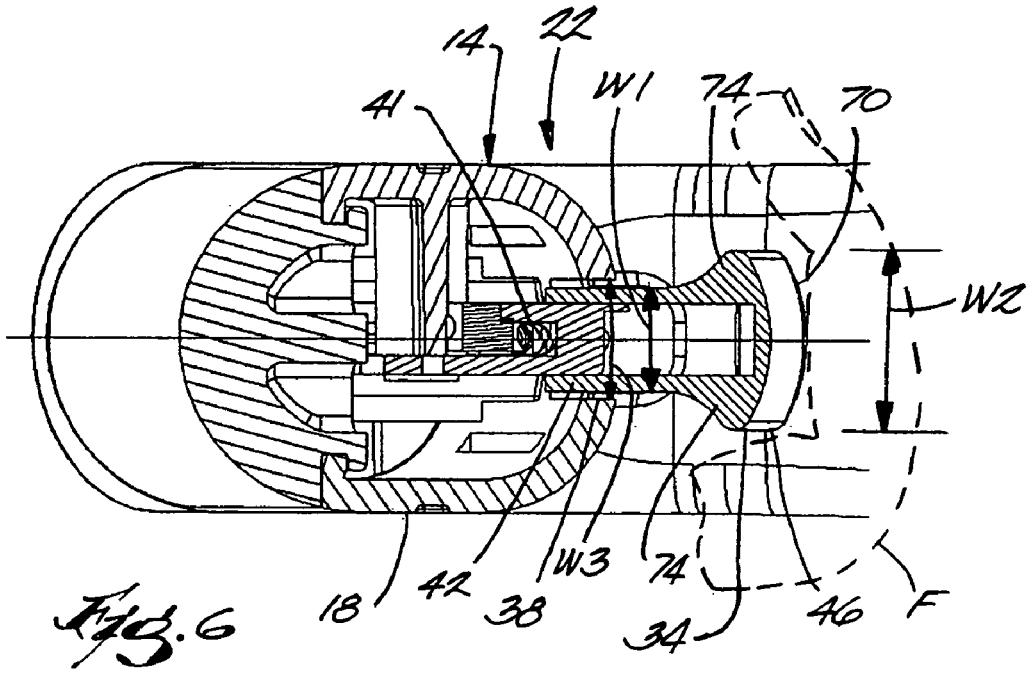
FIG. 6 is a cross-sectional top view of a portion of the power tool and the trigger assembly shown in FIG. 1 taken generally along line 6—6.

In the illustrated construction, the trigger 34 is biased toward the rest position (shown in FIG. 2) by a spring 41 (shown in FIG. 6). The operator's hand generally grips the handle 18, and the operator's finger F engages the trigger 34 to actuate the trigger 34. The trigger 34 includes a support portion 42 supported by the housing 14 and a contact portion 46 engaged by the operator's finger F to actuate the trigger 34.

Figure 3:
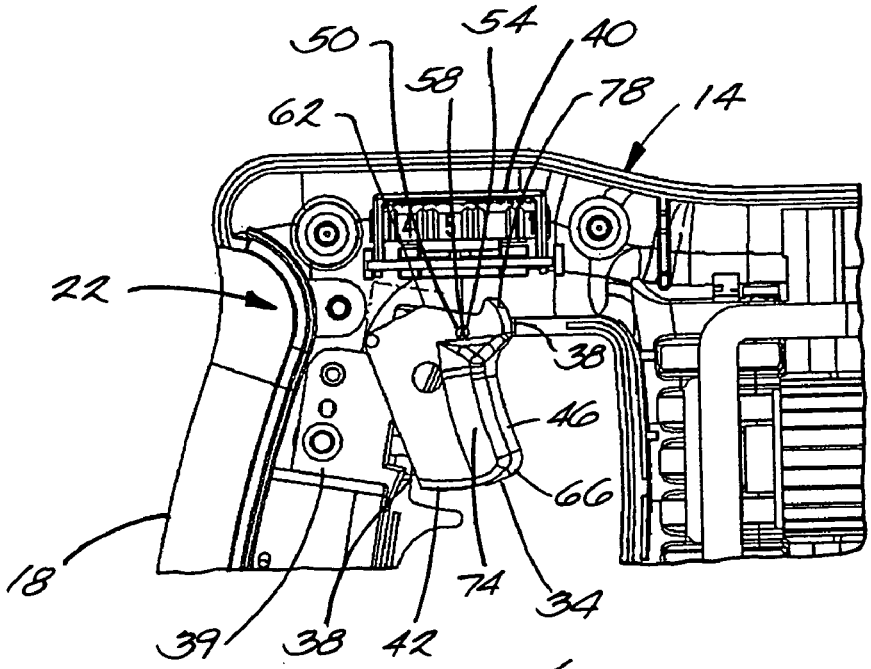
FIG. 3 is a partial cross-sectional side view of the trigger assembly shown in FIG. 2.

FIG. 3 illustrates an enlarged cross-sectional side view of a portion of the power tool 10 with the trigger 34 in the rest position. As mentioned above, the housing 14 defines an opening 38 near the handle 18, and the support portion 42 of the trigger 34 at least partially extends through the opening 38 and into the handle 18. As shown in FIG. 3, a pin 50 extends through apertures 54 in the trigger 34 and pivotally connects the trigger 34 to the switch 39. The trigger 34 has a pivot axis 58 defined by the pin 50. The trigger 34 has a pivot end 62 and a free end 66. The apertures 54 and pin 50 are disposed near the pivot end 62 within the housing 14. The trigger 34 extends lengthwise from the pivot end 62 to the free end 66. As the trigger 34 is actuated, the free end 62 generally pivots about the pin 50.

The handle 18 has a first surface and a second surface adjacent one another. In the illustrated construction, the first surface is generally behind the trigger 34 along a portion of the handle 18 gripped by an operator and the second surface is generally above the trigger 34. The first surface at least partially defines the opening 38, and the second surface at least partially defines a path. As shown in FIG. 3, the support portion 42 at least partially extends through the opening 38, and the opening 38 also includes the path of the second surface. In the illustrated construction, the trigger 34 may pivot with respect to the handle 18. The trigger 34 also at least partially extends through the opening 38 or path in the second surface, and engages the opening 38 or path when the trigger 34 pivots. In some aspects and in some constructions, the path on the second surface may include a surface, a ridge, a groove, a recess, a slot, or other similar guide structures.

FIG. 6 illustrates a cross-sectional top view of the trigger device 22. The support portion 42 has a first width W1, and the contact portion 46 has a second width W2. In the illustrated construction and in some aspects, the contact portion 46 is wider than the support portion 42 (i.e., the width W2 of the contact portion 46 is greater than the width W1 of the support portion 42). The opening 38 has an opening width W3, and the width W2 of the contact portion 46 is also greater than the opening width W3. The contact portion 46 also includes a length L1 (shown in FIG. 2), and the second width W2 (FIG. 6) of the contact portion 46 is substantially constant along the length L1 (FIG. 2).

As mentioned above, the operator's finger may engage the contact portion 46 to actuate the trigger 34. The operator applies a force on the trigger 34 to actuate the trigger 34 against the biasing force. Because the contact portion 46 is relatively wide (compared to the prior art trigger 114 shown in FIG. 8), the force applied by the operator is spread out over a larger surface area, and the pressure on the operator's finger is reduced. In the illustrated construction, the contact portion 46 includes a curved surface 70 that minimizes sharp corners on the contact portion 46 and that provides a smooth rounded, contoured surface for the operator's finger to engage. In some aspects and in some constructions, the wider contact portion 46 provides an ergonomic surface on the trigger 34 for the operator's finger. The wider contact portion 46 also increases comfort and may increase control for the operator.

In the illustrated construction and in some aspects, the contact portion 46 is wider than the support portion 42. The support portion 42 extends through the opening 38 and is at least partially disposed within the housing 14. The contact portion 46 is disposed outside the housing 14. As shown in FIG. 6, the trigger 34 includes an angled portion 74 that extends from the wider contact portion 46 to the narrower support portion 42. The angled portion 74 provides a smooth transition from the contact portion 46 to the support portion 42 and provides stability for the trigger 34.

Because the support portion 42 extends through the opening 38, the opening 38 must be at least as wide as the support portion 42. As mentioned above, the opening 38 has an opening width W3. The opening width W3 and the support portion 42 may be the standard width of some prior art trigger devices (such as the prior art trigger 114 shown in FIG. 8).

Figure 8:
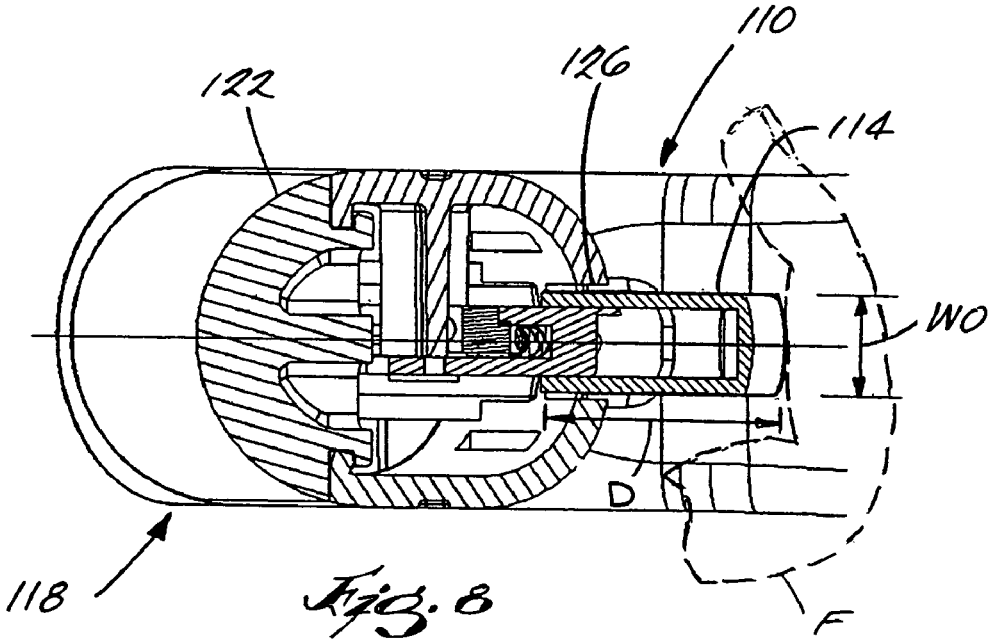
Fig. 8 PRIOR ART
FIG. 8 is a cross-sectional top view of a prior art trigger device and a portion of a power tool.

In the illustrated construction, as shown in FIG. 6, the width of the opening 38 is approximately the same as the standard opening of some prior art trigger devices (such as the prior art trigger device 110 shown in FIG. 8). Therefore, with the trigger 34, the contamination risk is not increased but remains substantially the same as some prior art trigger devices.

The trigger 34 of the illustrated construction may be retro-fittable into existing power tools. The width W1 of the support portion 42 of the trigger 34 is substantially the same as the standard width dimension W0 of the prior art trigger device 110 shown in FIG. 8 so that the trigger 34 is supportable on the prior art power tool in the opening 126.

The narrow support portion 42 of the trigger 34 permits the trigger 34 to provide the ergonomic benefits of the wider contact portion 46 on existing power tools. Also, because the support portion 42 maintains a standard width, the trigger 34 may be incorporated into new power tools without changing the existing design and manufacturing specifications and sizes for the housing 14 (including the size of the opening 38).

As described above, FIG. 9 illustrates a prior art trigger device 110 having a gap 130 between the trigger 114 and the housing 118 that is exposed when the trigger 114 is moved to the depressed position. With the prior art device 110, the operator's finger F may enter the gap 130 and may be pinched between the trigger 114 and the housing 118.

Figure 4:
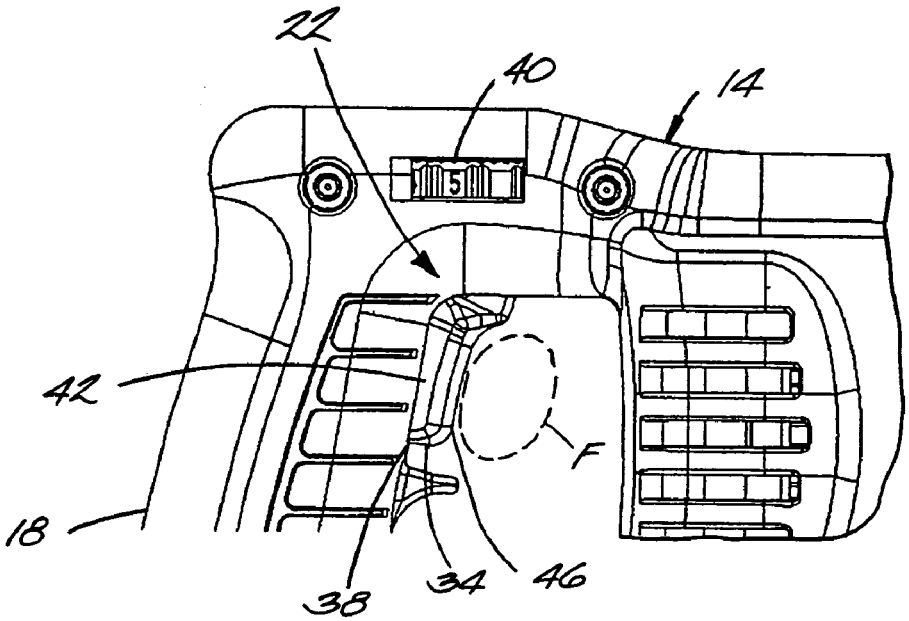
FIG. 4 is an enlarged side view similar to that shown in FIG. 2 with the trigger in the depressed position.
Figure 5:
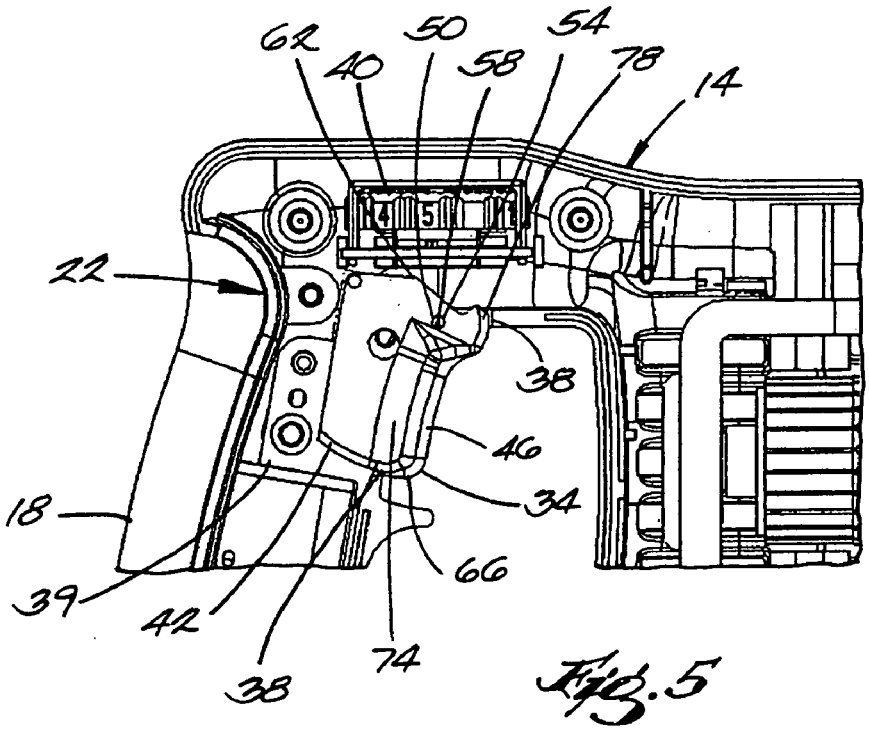
FIG. 5 is a cross-sectional side view of the trigger assembly shown in FIG. 4.
Figure 7:
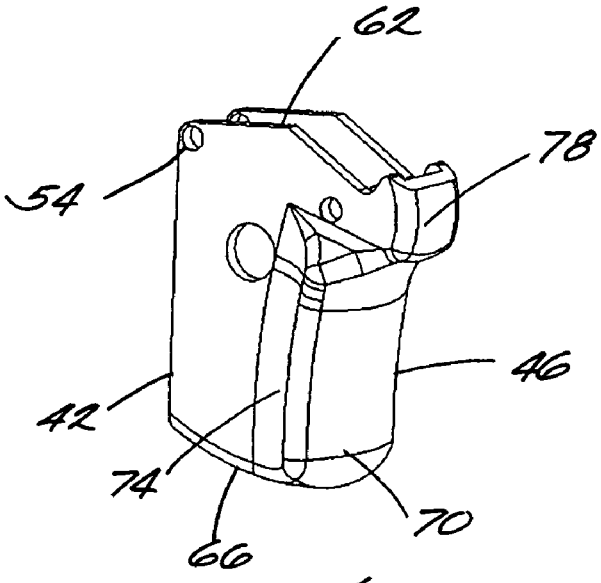
FIG. 7 is a perspective view of the trigger shown in FIG. 1.

As shown in FIGS. 3, 5 and 7, in some constructions and in some aspects, the trigger 34 includes an upper protrusion 78 that projects outwardly from the contact portion 46 near the pivot end 62 of the trigger 34. The upper protrusion 78 extends into the space near the contact portion 46 between the trigger 34 and the housing 14. The operator's finger is comfortably positioned below the upper protrusion 78 (as shown in FIG. 4). The upper protrusion 78 remains in the opening 38 as the trigger 34 is pivoted between the rest position (FIG. 3) and the depressed position (FIG. 5). The upper protrusion 78 may prevent the operator's finger from moving into the space and being pinched between the trigger 34 and the housing 14 as the trigger 34 pivots to the rest position.

In other constructions (not shown), the housing 14 or the trigger 34 may include a portion covering the space between the trigger 34 and the housing 14 to prevent the operator's finger entering the space and to thereby prevent the operator's finger from being pinched in the space.

FIGS. 10–16 illustrate additional views of the trigger 34 having the contact portion 46 wider than the support portion 42.

Figure 17:
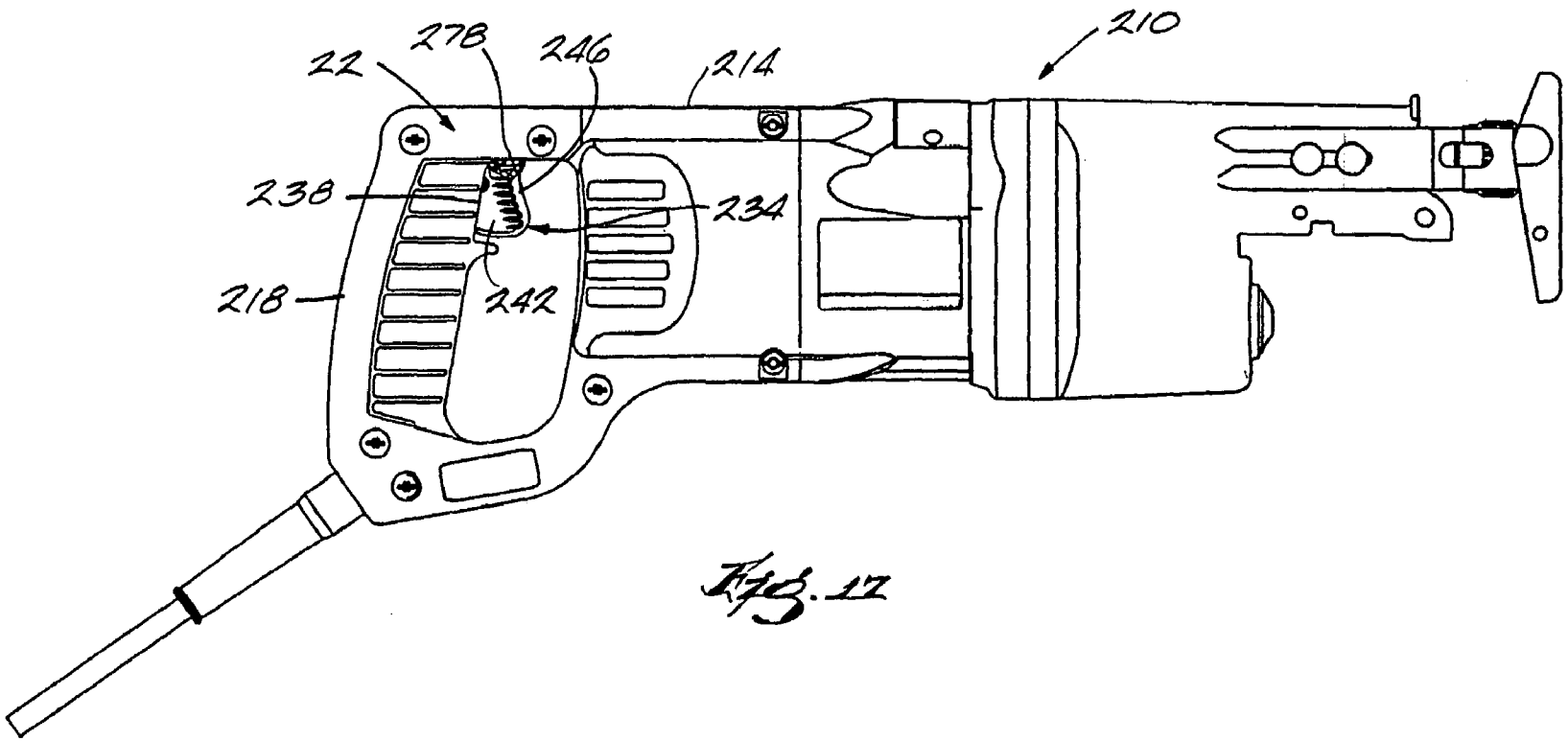
FIG. 17 is a side view of a power tool and an alternative trigger assembly embodying aspects of the invention.
Figure 18:
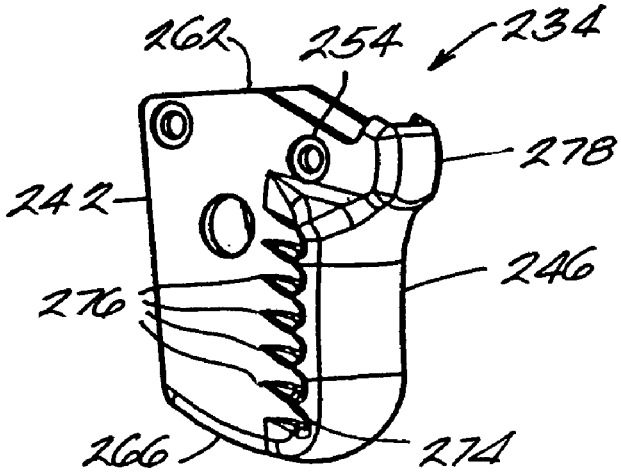
FIG. 18 is a front perspective view of the trigger shown in FIG. 17.
Figure 19:
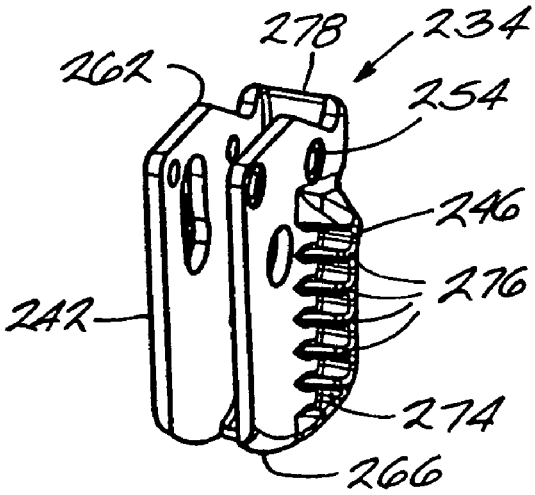
FIG. 19 is a rear perspective view of the trigger shown in FIG. 17.

FIG. 17 illustrates another construction of a power tool 210 and a trigger assembly 222 embodying aspects of the invention. The power tool 210 includes a housing 214 providing a handle 218, and the trigger assembly 222 is supported on the handle 218. The trigger assembly 222 includes a trigger 234 movably supported by the handle 218. The handle 218 defines an opening 238, and at least a portion of the trigger 234 extends through the opening 238 and into the handle 218. In the illustrated construction, the trigger 234 is pivotally supported by the handle 218, and the trigger 234 is movable between a rest position and a depressed position.

Figure 9:
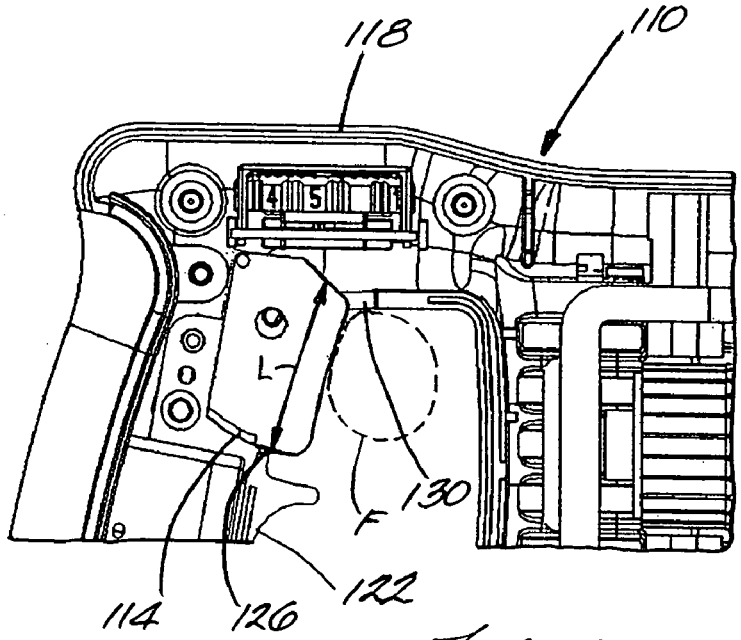
Fig. 9 PRIOR ART
FIG. 9 is a cross-sectional side view of a prior art trigger device and a portion of a power tool.
Figure 10:
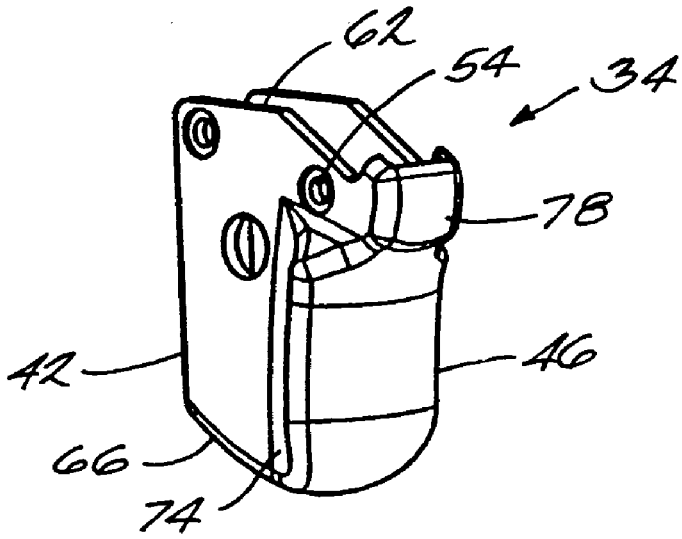
FIG. 10 is a front perspective view of the trigger shown in FIG. 1.
Figure 11:
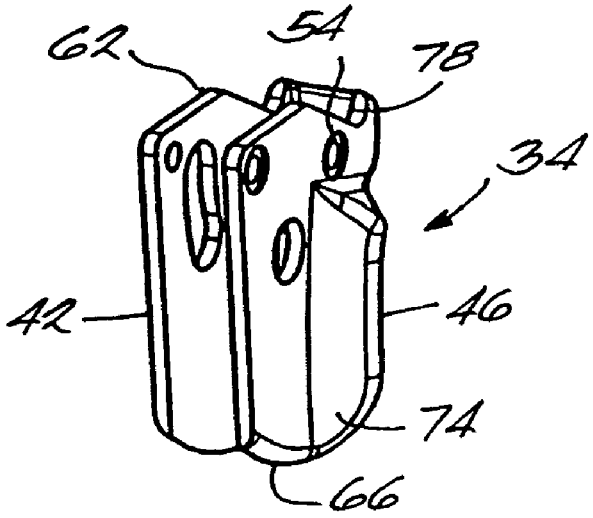
FIG. 11 is a rear perspective view of the trigger shown in FIG. 1.
Figure 12:
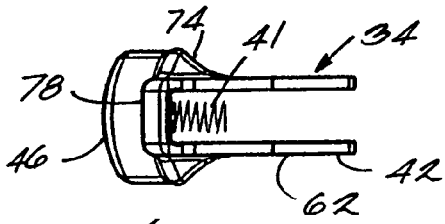
FIG. 12 a top view of the trigger shown in FIG. 1.
Figure 14:
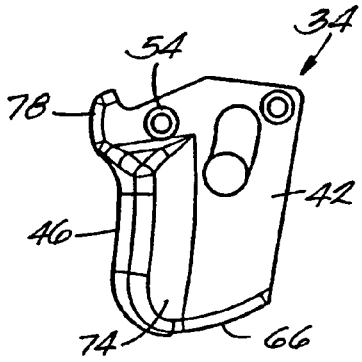
FIG. 14 a side view of the trigger shown in FIG. 1.
Figure 13:
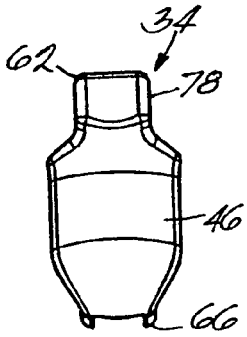
FIG. 13 a front view of the trigger shown in FIG. 1.
Figure 15:
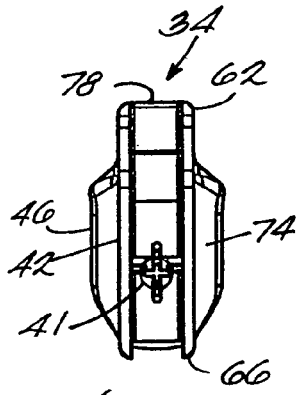
FIG. 15 a rear view of the trigger shown in FIG. 1.
Figure 16:
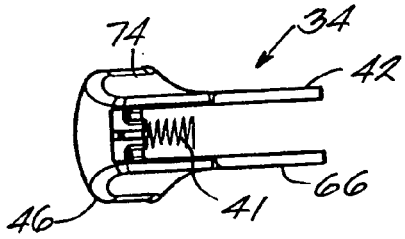
FIG. 16 a bottom view of the trigger shown in FIG. 1.

The trigger 234 is similar to the trigger 34 described above and shown in FIGS. 1–7 and 10–16, and the trigger 234 may be interchangeable with the trigger 34, and may also be substituted for the prior art trigger device 110 (FIGS. 8–9). The trigger 234 may also be operable with a switch assembly to control a switch which selectively connects the power source to the motor to drive the tool element, such as that shown with the trigger 34 in FIGS. 1–7. In the illustrated construction shown in FIG. 17, the trigger 234 includes a support portion 242 supported by the housing 214 and a contact portion 246 engageable by an operator's finger to actuate the trigger 234.

Similar to the trigger 34, as shown in FIGS. 17–24, the contact portion 246 of the trigger 234 is wider than the support portion 242. The support portion 242 extends through the opening 238 and is at least partially disposed within the housing 214, and the contact portion 246 is disposed outside the housing 214.

As shown in FIGS. 18–24, the trigger 234 may include apertures 254 which may engage a pin to permit pivotal movement of the trigger 234. The trigger 234 has a pivot end 262 and a free end 266. The apertures 254 are disposed near the pivot end 262 within the housing 214. The trigger 234 extends lengthwise from the pivot end 262 to the free end 266.

Figure 20:
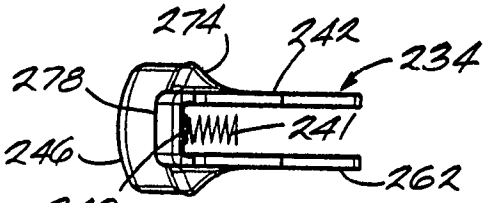
FIG. 20 a top view of the trigger shown in FIG. 17.
Figure 23:
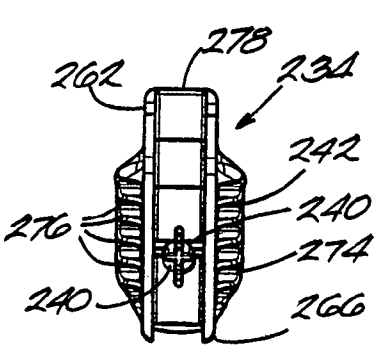
FIG. 23 a rear view of the trigger shown in FIG. 17.
Figure 22:
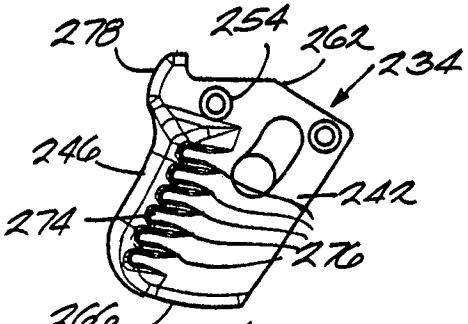
FIG. 22 a side view of the trigger shown in FIG. 17.
Figure 24:
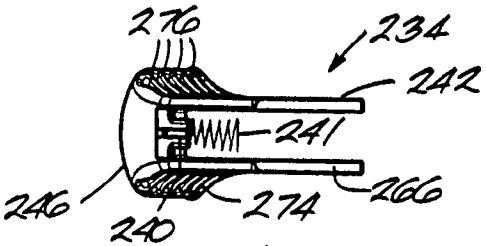
FIG. 24 a bottom view of the trigger shown in FIG. 17.
Figure 21:
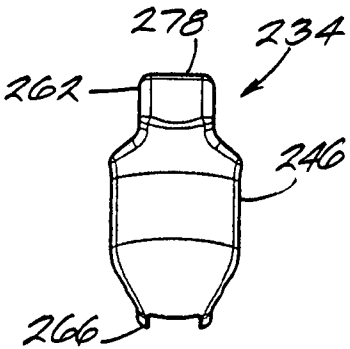
FIG. 21 a front view of the trigger shown in FIG. 17.

As shown in FIGS. 20 and 23–24, the trigger 234 includes a boss 240 projecting from the back of the contact portion 246 within an interior portion of the trigger 234. A spring 241 may engage the boss 240 to bias the trigger 234 toward a rest position when the trigger 234 is connected to the handle 218 (FIG. 17).

In the illustrated construction, the trigger 234 includes an angled portion 274 that extends from the wider contact portion 246 to the narrower support portion 242. The angled portion 274 provides a smooth transition from the contact portion 246 to the support portion 242 and provides stability for the trigger 234. In the illustrated construction, the angled portion 274 has a generally webbed shape, and includes multiple ribs 276 extending from the contact portion 246 to the support portion 242. Adjacent ribs 276 define grooves, or recesses, between one another.

The ribs 276 provide support for the relatively wider contact portion 246. The grooves between the ribs 276 reduce the weight of the trigger 234 and reduce the amount of material used to form the trigger 234. In the illustrated construction, the trigger 234 may be formed of a plastic material and may be formed using a molding process.

As shown in FIGS. 18–24, the trigger 234 includes an upper protrusion 278 that projects outwardly from the contact portion 246 near the pivot end 262 of the trigger 234. The upper protrusion 278 extends into the space near the contact portion 246 between the trigger 234 and the housing 214 (FIG. 17). As described above, the upper protrusion 278 may prevent the operator's finger from moving into the space and being pinched between the trigger 234 and the housing 214 (FIG. 17) as the trigger 234 pivots to the rest position.

Figure 25:
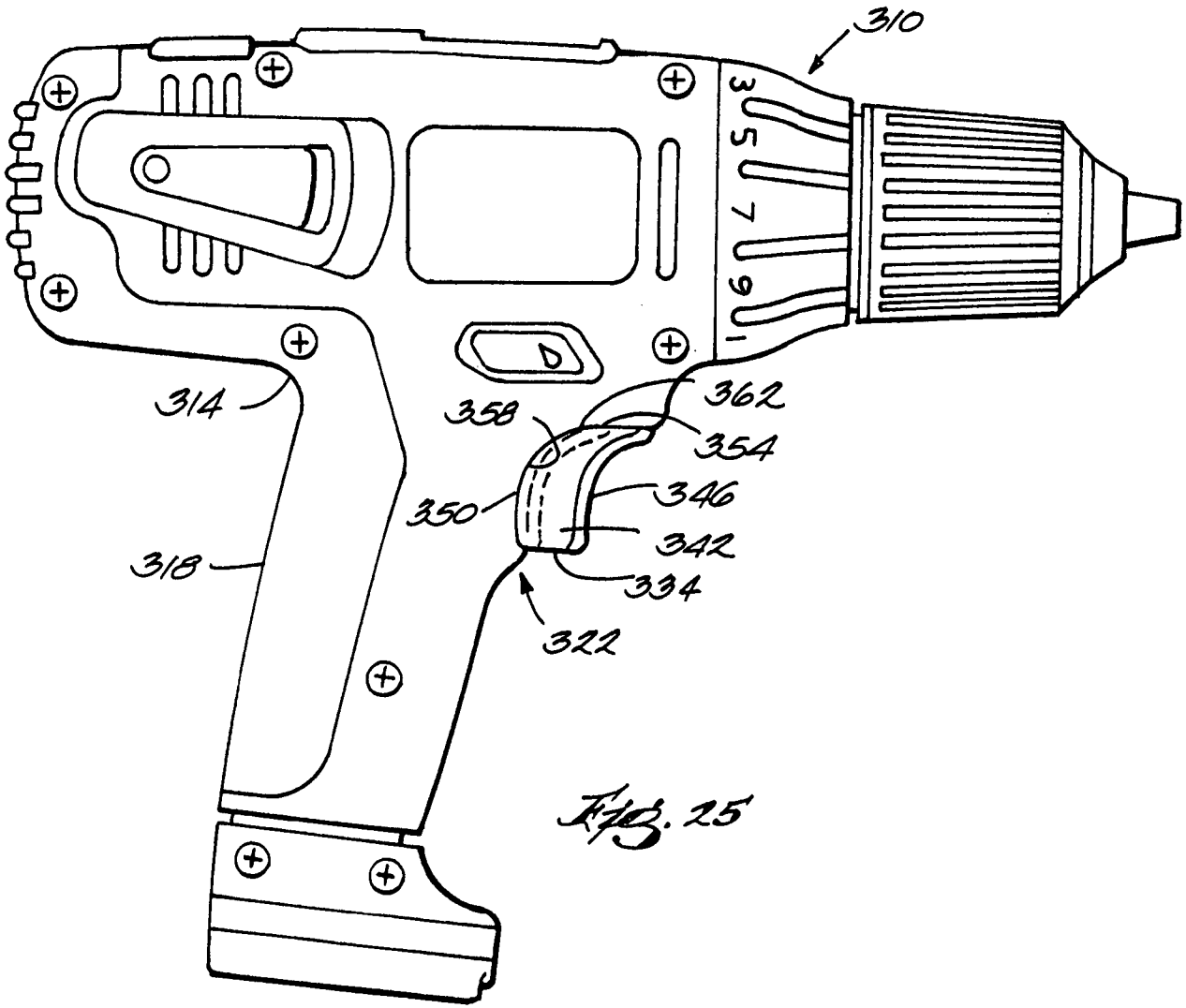
FIG. 25 is a side view of a power tool and a trigger assembly embodying aspects of the invention.

FIG. 25 illustrates a construction in which a power tool 310 includes a drill. The power tool 310 includes a housing 314 having a handle 318, and a trigger assembly 322 having a trigger 334 movably supported by the handle 318. In the illustrated embodiment, the trigger 334 is supported for linear movement relative to the handle between a rest position (shown in solid lines) and a depressed position (shown in broken lines). The trigger 334 may be operable to control a switch, similar to the switch 39 described above.

The trigger includes a support portion 342 supported by the housing 314 and a contact portion 346 engaged by the operator's finger to actuate the trigger 334. The support portion 342 has a first width dimension, and the contact portion 346 has second width dimension greater than the first width dimension, similar to the trigger 43 described above. The handle 318 includes a first surface 350 and a second surface 354 adjacent the first surface 350. The trigger 334 generally moves toward the first surface 350 and along the second surface 354 when moving from the rest position to the depressed position.

The first surface 350 at least partially defines an opening 358 and the support portion 342 at least partially extends through the opening 358. The second surface 354 defines a path 362, and the trigger 334 at least partially engages the path 362 when moving with respect to the handle 318. In the illustrated construction, the path 362 includes a recess, and the trigger 334 at least partially engages the recess and slides along the path 362 when moving between the rest and depressed positions. In some aspects and in some constructions, the path 362 may include a surface, a ridge, a groove, a slot, an opening, or other similar guide structures. If the path 362 defines an opening, the opening may be a single continuous opening from opening 358.

One or more independent features and independent advantages are set forth in the following claims:

We claim:

1. A trigger assembly comprising:

a housing having an exterior first surface and a second surface adjacent the first surface, the first surface at least partially defining an opening and the second surface at least partially defining a path; and a trigger movably supported by the housing and at least partially engaging the path when moving with respect to the housing, the trigger including a support portion at least partially extending through the opening into the housing, the support portion having a first width, and a contact portion connected to the support portion and disposed outside the housing, the contact portion having a second width greater than the first width.

2. The trigger assembly of claim 1, wherein the opening has an opening width, and wherein the second width is greater than the opening width.

3. The trigger assembly of claim 1, wherein the contact portion has a length, and wherein the second width is substantially constant along the length.

4. The trigger assembly of claim 1, wherein the trigger is pivotally supported by the housing.

5. The trigger assembly of claim 4, wherein the trigger pivots about a pivot axis, the pivot axis being substantially parallel to the second width.

6. The trigger assembly of claim 5, wherein the pivot axis extends through the housing.

7. The trigger assembly of claim 1, wherein an operator's finger contacts the contact portion and extends in the substantially same direction as the second width.

8. The trigger assembly of claim 1, wherein the contact portion includes a convex curved surface opposite the support portion and curved along the second width.

9. The trigger assembly of claim 1, wherein a space is defined between the trigger and a portion of the housing surrounding the opening, and wherein the trigger further includes an upper protrusion projecting outwardly from the contact portion into the space between the trigger and the housing.

10. The trigger assembly of claim 1, wherein the trigger is moveable between a rest position and a depressed position.

11. The trigger assembly of claim 10, wherein the trigger is biased toward the rest position.

12. The trigger assembly of claim 1, wherein the path includes a second opening, the trigger at least partially extending through the second opening.

13. The trigger assembly of claim 1, wherein the path includes a recess.

14. The trigger assembly of claim 1, wherein the path includes a recess.

15. A power tool comprising:

a housing;

a handle connected to the housing and having an exterior first surface and a second surface adjacent the first surface, the first surface at least partially defining an opening and the second surface at least partially defining a path; and a trigger movably supported by the housing and at least partially engaging the path when moving with respect to the handle, the trigger including a support portion at least partially extending through the opening into the housing, the support portion having a first width, and a contact portion connected to the support portion and disposed outside the housing, the contact portion having a second width greater than the first width.

16. The power tool of claim 15, wherein the opening has an opening width, and wherein the second width is greater than the opening width.

17. The power tool of claim 15, wherein the contact portion has a length, and wherein the second width is substantially constant along the length.

18. The power tool of claim 15, wherein the trigger is pivotally supported by the handle.

19. The power tool of claim 18, wherein the trigger pivots about a pivot axis, the pivot axis being substantially parallel to the second width.

20. The power tool of claim 19, wherein the pivot axis extends through the housing.

21. The power tool of claim 15, wherein an operator's finger contacts the contact portion and extends in the substantially same direction as the second width.

22. The power tool of claim 15, wherein the contact portion has a convex curved surface opposite the support portion and curved along the second width.

23. The power tool of claim 15, wherein a space is defined between the trigger and the portion of the handle surrounding the opening, and wherein the trigger further includes an upper protrusion projecting outwardly from the contact portion into the space between the trigger and the handle.

24. The power tool of claim 15, wherein the trigger is moveable between a rest position and a depressed position.

25. The power tool of claim 24, wherein the trigger is biased toward the rest position.

26. The power tool of claim 15, further comprising a motor disposed within the housing and connectable to a power source, and a switch operated by the trigger and operable to selectively connect the motor to the power source.

27. The trigger assembly of claim 15, wherein the path includes a second opening, the trigger at least partially extending through the second opening.

28. A trigger assembly comprising:

a housing having an exterior surface defining an opening; and a trigger movably supported by the housing, a space being defined between the trigger and the portion of the housing surrounding the opening, and the trigger including a support portion at least partially extending through the opening into the housing, a contact portion connected to the support portion and disposed outside the housing, and an upper protrusion projecting outwardly from the contact portion into the space between the trigger and the housing.

29. The trigger assembly of claim 28, wherein the support portion has a first width, and wherein the contact portion has a second width greater than the first width.

30. The trigger assembly of claim 29, wherein the opening has an opening width, and wherein the second width is greater than the opening width.

31. The trigger assembly of claim 29, wherein the contact portion has a length, and wherein the second width is substantially constant along the length.

32. The trigger assembly of claim 29, wherein the contact portion has a convex curved surface opposite the support portion and curved along the second width.

33. The trigger assembly of claim 28, wherein the trigger is pivotally supported by the housing.

34. The trigger assembly of claim 28, wherein the trigger is moveable between a rest position and a depressed position.

35. The trigger assembly of claim 34, wherein the trigger is biased toward the rest position.

36. A power tool comprising:

a housing;

a handle connected to the housing and having an exterior surface defining an opening; and a trigger movably supported by the handle, a space being defined between the trigger and the portion of the handle surrounding the opening, the trigger including a support portion at least partially extending through the opening into the housing, a contact portion connected to the support portion and disposed outside the housing, and an upper protrusion projecting outwardly from the contact portion into the space between the trigger and the handle.

37. The power tool of claim 36, wherein the support portion has a first width, and wherein the contact portion has a second width greater than the first width.

38. The power tool of claim 37, wherein the opening has an opening width, and wherein the second width is greater than the opening width.

39. The power tool of claim 37, wherein the contact portion has a convex curved surface opposite the support portion and curved along the second width.

40. The power tool of claim 36, wherein the contact portion has a length, and wherein the second width is substantially similar along the length.

41. The power tool of claim 36, wherein the trigger is pivotally supported by the handle.

42. The power tool of claim 36, wherein the trigger is moveable between a rest position and a depressed position.

43. The power tool of claim 42, wherein the trigger is biased toward the rest position.

44. The power tool of claim 36, further comprising a motor disposed within the housing and connectable to a power source, and a switch operated by the trigger and operable to selectively connect the motor to the power source.

45. A trigger assembly comprising:

a housing defining an opening; and a trigger movably supported by the housing, a space being defined between the trigger and the portion of the housing surrounding the opening, and the trigger including:

a support portion at least partially extending through the opening into the housing;

a contact portion connected to the support portion and disposed outside the housing;

an upper protrusion projecting outwardly from the contact portion into the space between the trigger and the housing; and multiple ribs extending between the support portion and the contact portion on opposite sides of the trigger, the ribs defining grooves between the ribs.

* * * * *